US006376012B1

(12) United States Patent
Innes et al.

(10) Patent No.: US 6,376,012 B1
(45) Date of Patent: Apr. 23, 2002

(54) CONTROL OF COATING THICKNESS IN SHEET ARTICLE COATERS

(75) Inventors: Robert Arthur Innes; Melville Douglas Ball, both of Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/547,949

(22) Filed: Apr. 12, 2000

Related U.S. Application Data

(60) Provisional application No. 60/129,020, filed on Apr. 13, 1999.

(51) Int. Cl.[7] ..... B05D 1/34; B05C 3/00

(52) U.S. Cl. ..... 427/209; 427/356; 118/122; 118/123; 118/125; 118/126; 118/411; 118/413; 118/428

(58) Field of Search ..... 427/209, 356; 118/122, 123, 125, 126, 411, 413, 428

(56) References Cited

U.S. PATENT DOCUMENTS 5,569,494 A * 10/1996 Suzuki et al. ..... 427/358
5,807,434 A 9/1998 Innes ..... 118/226

FOREIGN PATENT DOCUMENTS

| | | | |
|---|---|---|---|
| WO | WO 94/27739 | | 8/1994 |
| WO | 96/15857 | * | 5/1996 |
| WO | 96/15860 | * | 5/1996 |

* cited by examiner

*Primary Examiner*—Katherine A. Bareford
(74) *Attorney, Agent, or Firm*—Cooper & Dunham LLP

(57) ABSTRACT

A process of producing an elongated coated strip article having a layer of coating material on each opposite surface of the strip article, in which the ratio of layer thicknesses on opposite sides of the strip article may be set or varied. The process comprises simultaneously applying layers of solidifiable liquid coating materials on the opposite sides of the strip article by advancing the strip article in a direction along a path between opposed coating heads, at least one of which is a floating coating head, having material delivery slots and metering lands for delivery and metering of the liquid coating materials to the opposite surface to form the layers. The ratio of the layer thicknesses may be adjusted when required by varying the path of strip article advance between the floating coating heads to cause changes in angles formed between the strip surfaces and adjacent metering lands on opposite sides of the strip article. The invention also provides apparatus for carrying out the process.

16 Claims, 10 Drawing Sheets

CONTROL OF COATING THICKNESS IN SHEET ARTICLE COATERS

CROSS-REFERENCE TO RELATED APPLICATION

This application claims the priority right of Provisional U.S. patent application Serial No. 60/129,020 filed Apr. 13, 1999 by applicants herein.

BACKGROUND OF THE INVENTION

This invention relates to a method and apparatus for two-sided coating of elongated strip articles, such as metal sheet or strip. More particularly, the invention relates to such coating achieved by the utilization of direct coating apparatus having floating extrusion heads facing opposite sides of the sheet or strip articles to be coated.

Direct coating of strip articles with layers of coating materials utilizing two-sided direct coaters is known, for example, from U.S. Pat. No. 5,807,434 to Robert A. Innes (hereinafter "the Innes Patent"), issued Sep. 15, 1998, and assigned to Alcan International Limited. This patent is concerned with two-sided sheet article coating utilizing the concept of "floating" coating heads directly opposing each other on opposite sides of the strip article to be coated. Each coating head has an elongated slot extending across the width of the strip article generally at right angles to the direction of advancement of the strip article through the coating apparatus. The slot allows solidifiable liquid coating material to be delivered into the gap formed between each coating head and the adjacent surface of the strip article to be coated. On the downstream side of the slot of each coating head (i.e. downstream relative to the direction of strip advancement), an extended, generally flat, sloping surface (referred to as a "land") is provided. This land slopes with a predetermined angle inwardly towards the surface to be coated in the direction of advancement of the strip article. The gap into which the coating material is delivered consequently narrows in the direction of strip advancement, and this causes the coating material to be compressed in the gap and to exert an outward force on the land as the material is squeezed to the desired coating film thickness. At least one of the coating heads is movable generally at right angles to the strip article and is urged by some form of pushing arrangement (e.g. hydraulic or pneumatic cylinders, springs, etc.) towards the strip. The outward force generated on the land by the coating material balances the inward force provided by the pushing arrangement pressing the coating head towards the strip article, causing the coating head to float on the newly forming film of coating material without actually touching the strip article itself. This floating effect allows a constant thickness of coating material to be applied to the strip surfaces regardless of the condition of those surfaces, since the floating coating heads follow any contours or irregularities of the strip thickness as the strip article is advanced through the coater apparatus.

Direct coaters of this kind can be used for applying various kinds of solvent-borne coatings (e.g. paints, lacquers, enamels, etc.) or molten solid coatings (e.g. molten polymers, etc.). The thickness of the coating can be controlled by varying certain coating parameters, such as the land (extended surface) width and angle, the effective viscosity of the coating medium, the speed of the strip article through the coating zone, the applied pressure, and the like. The effect of varying these parameters may be quite complex. If the conditions employed for each coating head are the same, the coating thicknesses will be the same on each side of the strip article. However, if different coating thicknesses are required on opposite sides of the strip article, or if the same coating thickness is required on each side despite the use of coating materials having different properties, special steps are required.

This can be important because it is often desirable in commerce to provide different coating materials or coating thicknesses on opposite sides of a strip article. For example, aluminum or other metal sheet material intended for beverage can bodies or can ends typically requires coatings of two microns or less on the side intended for the outside of the can, but (for some beverages, e.g. those containing acids or salts) requires coatings of seven microns or more on the side intended for the inside of the can. The properties of the coating materials on the two opposite sides may also have to be different. For example, inner surfaces generally need to be compatible with food or beverages, while outer surfaces may require durable protection to resist abrasions during product handling.

As disclosed in the Innes patent, the ratio of coating film thickness on the two sides of the strip article can be controlled in two ways, i.e. by providing coating heads with different land angles and/or lengths (in the direction of the strip article advance) on each side of the strip, or by employing different coating formulations, which exhibit different viscosities under the high shear coating conditions, for the two coating heads. Variations in coating speeds cannot be used to produce differences of the thickness ratio (since, in two-sided coaters, both sides of the strip are coated simultaneously); similarly, different pressing forces cannot be appied to the coating heads, since the floating nature of the coating heads means that forces are balanced on opposite sides of the strip. This is unfortunate because coating speeds and pressing forces are easy to vary (i.e. in single-sided coating equipment), whereas differences of land angle and width can only be achieved by stopping the coating line and changing coating heads. Moreover, while it is easy to use coating materials of different formulation in the coating heads of two-sided coaters, the intended end use of the coated strip article may dictate the nature of the coating formulations, so there may in many cases be no freedom to choose formulations that would produce a desired thickness ratio.

The Innes patent discloses the concept of making one of the coating heads pivotable so that the angle between the land and the surface to be coated can be varied, e.g. by means of a set screw arrangement. The main problem with this is the mechanical complexity required for varying the angle without affecting the alignment of the lands. Unless the axis of rotation is coincident with the trailing edge of the land, rotation of the die to change the angle of the land will cause a component of displacement of the land in a direction parallel to the advance of the strip article. Such a displacement may cause misalignment of the coating heads and adversely affect the balance of forces. While it is conceivable to avoid such misalignment, or to provide for simultaneous rotation and translation of the land, this would be quite complex in practice.

There is therefore a need for an improved process and apparatus that will allow the coating thickness of coating films produced in two-sided direct coaters employing floating coating heads to be varied either when the apparatus is initially being set up for coating, or as the coating operation proceeds. There is a particular need for an improved process and apparatus whereby thickness ratios of coatings on opposite sides of strip articles may be varied easily and accurately during two-sided direct coating as the coating operation proceeds. Also, there is often a need to enable coating layers of the same thickness to be produced when different coating materials must be applied to opposite sides of the strip, or when coating heads of different dimensions are used on opposite sides of the strip article.

BRIEF SUMMARY OF THE INVENTION

An object of the invention is to provide a method and apparatus for double-sided coating of sheet articles with a coating film whereby the coating thickness may be adjusted when required by simple and convenient means.

According to one aspect of the invention, there is provided a process of producing an elongated coated strip article having a layer of coating material on each opposite surface of the strip article, each layer having a layer thickness and the coated strip article having a ratio of said layer thicknesses at any point on the strip article, the process comprising simultaneously applying layers of solidifiable liquid coating materials on said opposite surfaces of the strip article by advancing the strip article in a direction along a path between opposed coating heads, at least one of which is a floating coating head, having material delivery slots and metering lands for delivery and metering of the liquid coating materials to said opposite surfaces to form said layers, wherein said ratio of said layer thicknesses is adjusted when required by varying said path of said strip article between said floating coating heads to cause changes in angles formed between said strip surfaces and adjacent metering lands on opposite sides of the strip article.

According to another aspect of the invention, there is provided a coating apparatus for simultaneously coating both opposed surfaces of an elongated strip article to form coating layers each having a layer thickness, the coated strip article having a ratio of said layer thicknesses at any point on the strip article, said apparatus comprising a pair of coating heads, at least one of which is a floating coating head, having delivery slots for solidifiable liquid coating material and metering lands for metering the liquid coating materials to form said layers, and a drive for advancing said elongated strip article in a direction along a path between said coating heads, said apparatus including an a deflection apparatus for varying said path of strip article advance between said floating coating heads to cause changes in angles formed between said strip article surfaces and adjacent metering lands on opposite sides of the strip article, thereby enabling adjustments of said ratio of said layer thicknesses when required.

The path of the strip article is generally the plane followed by the strip article as it advances between the coating heads. This plane can, according to the present invention, be rotated about a notional transverse axis normally, but not necessarily, located approximately between the trailing (downstream) edges of the coating heads.

The way in which the variation of the path angle of the strip article causes changes in the coating thickness ratio can be quite complex. The complexity may be best dealt with by following one of three possible approaches, as follows:

1) The path angle for providing a particular thickness ratio is determined either by computation or advance experimentation and accurately set in advance without computer control.
2) The path angle is accurately set in advance but with computer control to maintain a precise angle during production.
3) The path angle is not accurately set in advance but is entirely under computer control during production.

The invention makes it possible to adjust the ratio of coating layer thicknesses without having to replace, rotate or displace the coating heads or coating lands of the coating equipment. Mechanical and logistical complexity are therefore reduced.

DETAILED DESCRIPTION OF THE INVENTION

Figure 1:
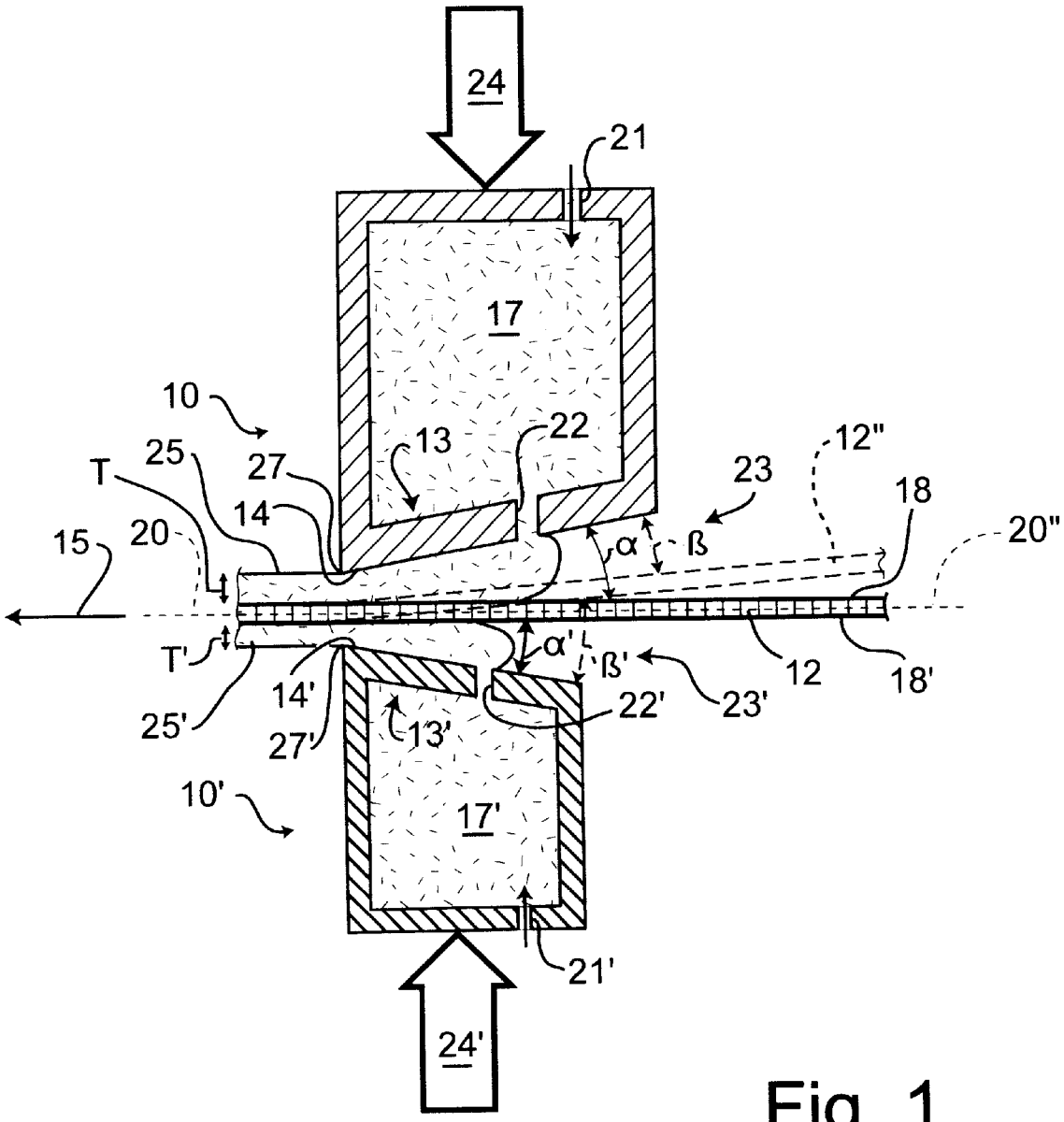
FIG. 1 is a schematic representation in vertical cross-section of a pair of opposed coating heads of a two-sided coating apparatus illustrating one preferred form of the present invention, in which the coating heads are of a different size.

FIG. 1 shows a cross-section of a pair of opposed floating coating heads 10, 10' positioned in register with each other on opposite sides of a strip article 12 to be coated. It will be appreciated that the coating heads 10, 10' will in most cases extend transversely across the entire width of a strip article 12, or across as much of the width as is desired to be coated. The coating heads each include a land portion 13, 13' having an extended generally flat surface forming a land 14, 14' facing the adjacent surface to be coated 18, 18' of the strip article 12. The strip article is advanced past the coating heads by conventional strip advancement means (not shown) in the direction of arrow 15 following a longitudinal path shown by broken line 20, 20" through the coating apparatus (i.e. an imaginary line followed by the strip article as it passes through the coating apparatus adjacent to the coating heads 10, 10'— sometimes referred to as the strip pass line or coating path).

A liquid coating material 17, 17' (which may be the same or different on the opposite sides of the strip article) such as paint or molten polymer, is introduced into each coating head 10, 10' from supply apparatus (not shown) via inlets 21, 21' and is extruded under pressure from coating slots 22, 22' provided immediately upstream (relative to the direction of movement of the strip article) of each land 14, 14'. The coating material extruded from the slots 22, 22' enters gaps 23, 23' formed between the coating heads and the strip article.

The lands 14, 14' are disposed at effective land angles $\alpha$, $\alpha'$ relative to the adjacent surfaces 18, 18' to be coated of the strip article. More precisely, the effective land angles $\alpha$, $\alpha'$ may be defined as the angles between the surfaces of the lands 14, 14' and the path 20, 20".

As the coating materials 17, 17' are drawn by the advancing strip article 12 beneath the lands 14, 14', they are metered (squeezed) into the narrowing gaps 23, 23' and exert a outward forces on the coating heads 10, 10'. These outward forces are counterbalanced by an inward (directed towards the strip article) force represented by arrows 24, 24' provided by a force applying device, e.g. a pneumatic cylinder, a hydraulic cylinder, a spring, counter weights, etc. (not shown in FIG. 1). In fact, if the strip article 12 is sufficiently flexible, only one of the coating heads needs to be movable, since the floating effect is achieved on the fixed head side of the strip by displacement of the strip rather than displacement of the fixed coating head.

The counterbalancing of forces means that the coating heads 10, 10' remain at a generally fixed distance from the adjacent surfaces to be coated 18, 18' during the coating process, despite surface height irregularities and, in effect, "float" on the surfaces 18, 18' without actually touching them. The coating material 17, 17' is metered to form coating films 25, 25' having final film thicknesses T, T' determined by the sloping land surfaces and the positions of the downstream (trailing) edges 27, 27' of the lands relative to the surfaces 18, 18' to be coated. All of this is conventional, as described in the Innes patent (the disclosure of which is specifically incorporated herein by reference).

The final film thickness T, T' of the coating layers 25, 25' can be adjusted by changing the angles $\alpha$, $\alpha'$. Initially, if one of these angles is made smaller (more shallow), the corresponding film thickness is reduced. Conversely, if the angle is made larger (more steep), the corresponding film thickness is increased. However, as the angles $\alpha$, $\alpha'$ are increased further, a point is generally reached at which further increases in the angle result in reductions of film thickness. The working range of the angles $\alpha$, $\alpha'$ depends on the viscosity and rheology of the coating material employed in the apparatus, but' generally falls within the range of 0.1 to 2°, preferably in the range 0.3 to 1.0°.

The present invention makes it possible to change the angles $\alpha$, $\alpha'$ during a coating operation without interruption of the procedure, or initially before proper coating starts during the apparatus set-up, or for change-over to a different desired coating thickness altogether. This allows for adjustment of the film thickness ratio (the ratio T:T') to any desired value, including 1.0 (i.e. T:T'=1:1).

This angle adjustment is achieved by adjusting the path 20, 20" of the strip article 12 in the region of the coating heads 12, 12', without tilting the coating heads or land portions 13, 13' in order to vary the effective land angles $\alpha$, $\alpha'$. Such an adjustment of the path of the strip is shown in broken lines 12" in FIG. 1, the adjusted effective land angles being shown as $\beta$, $\beta'$. Once the coating apparatus has been set up to make such changes possible, variation of the coating angles can be achieved simply and quickly during operation of the apparatus without having to interrupt the coating operation.

It will be seen that, on the upper side of the strip as shown, the change of angle from $\alpha$ to $\beta$ amounts to a reduction of the coating angle. In contrast, on the lower side of the strip, the hange from angle $\alpha'$ to $\beta'$ amounts to an increase of the coating angle. In consequence, the change to the coating thickness ratio is somewhat "boosted" by the changes taking place on the opposite sides of the strip at the same time.

In general, variations in the effective coating angle a in the range of 0.1 to 1.0° are usually effective to produce desired the thickness ratio by an amount in the range of 4:1 when all other parameters are the same top and bottom.

When changes are made to the coating angles (by adjusting the coating path of the strip article), care should be taken to ensure that the coating material is supplied in proper amounts on the opposite sides of the strip. The change of coating angle will result in the application of a thicker or thinner coating to the strip article on each side. If the coating is made thinner, in some embodiments of the invention, less coating material should preferably be fed into gap 23, 23' to avoid overflow, and conversely, if the coating is made thicker, more coating material should preferably be fed into the gap 23, 23' to avoid starvation of coating material and loss of expected film thickness or integrity. The preferred adjustment of feed of the coating material may be achieved by adjusting the pressure of the coating material in each coating head 10, 10', e.g. by adjusting the pressure of coating material produced by the feed apparatus. This adjustment of pressure may be carried out manually or under computer control, but should be varied as the coating path of the strip article is adjusted.

Figure 2A:
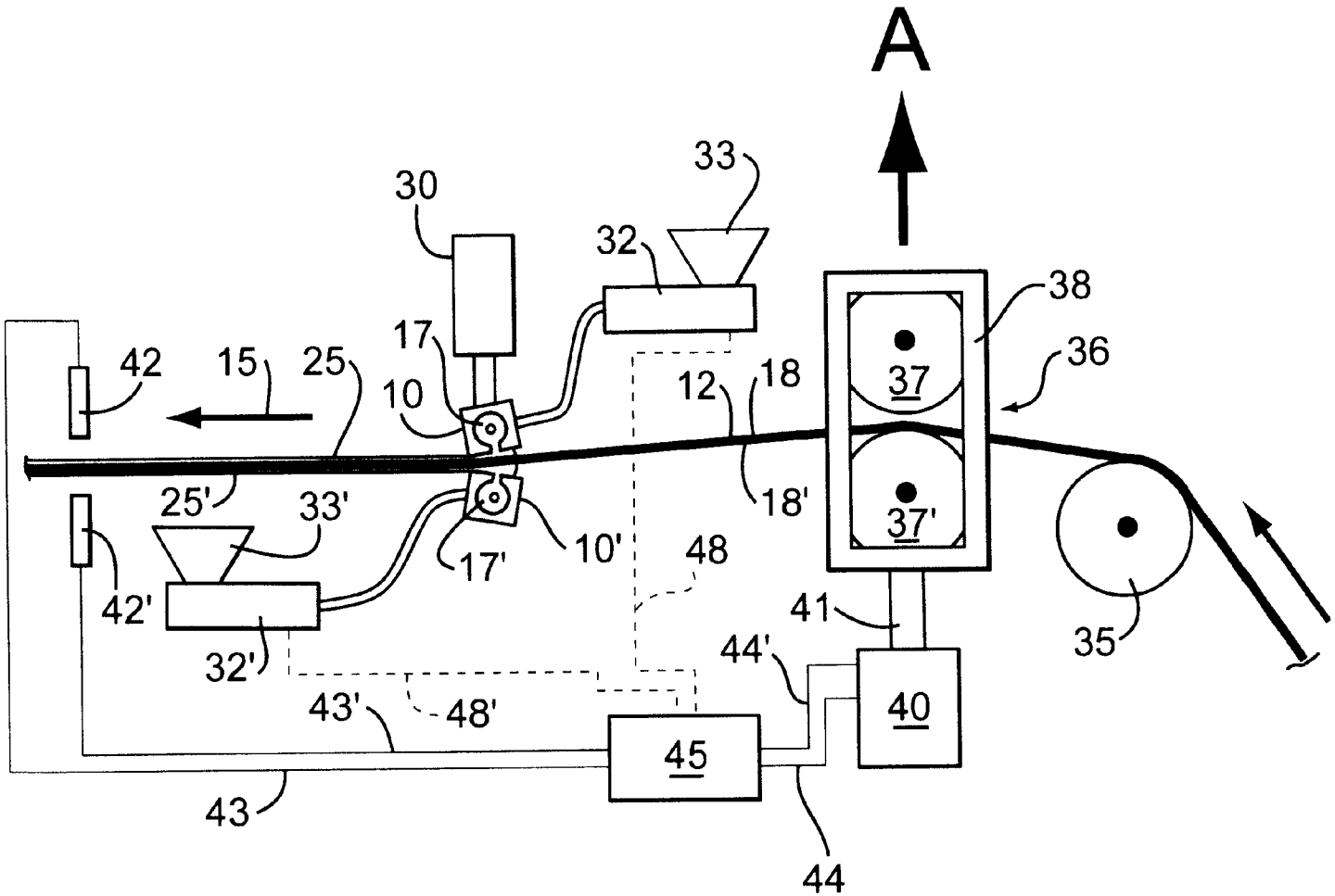
FIG. 2A is a schematic representation of a two-sided coating apparatus illustrating another preferred form of the present invention, in which the coating heads are of the same size and means for varying the path angle are shown in a first position.
Figure 2B:
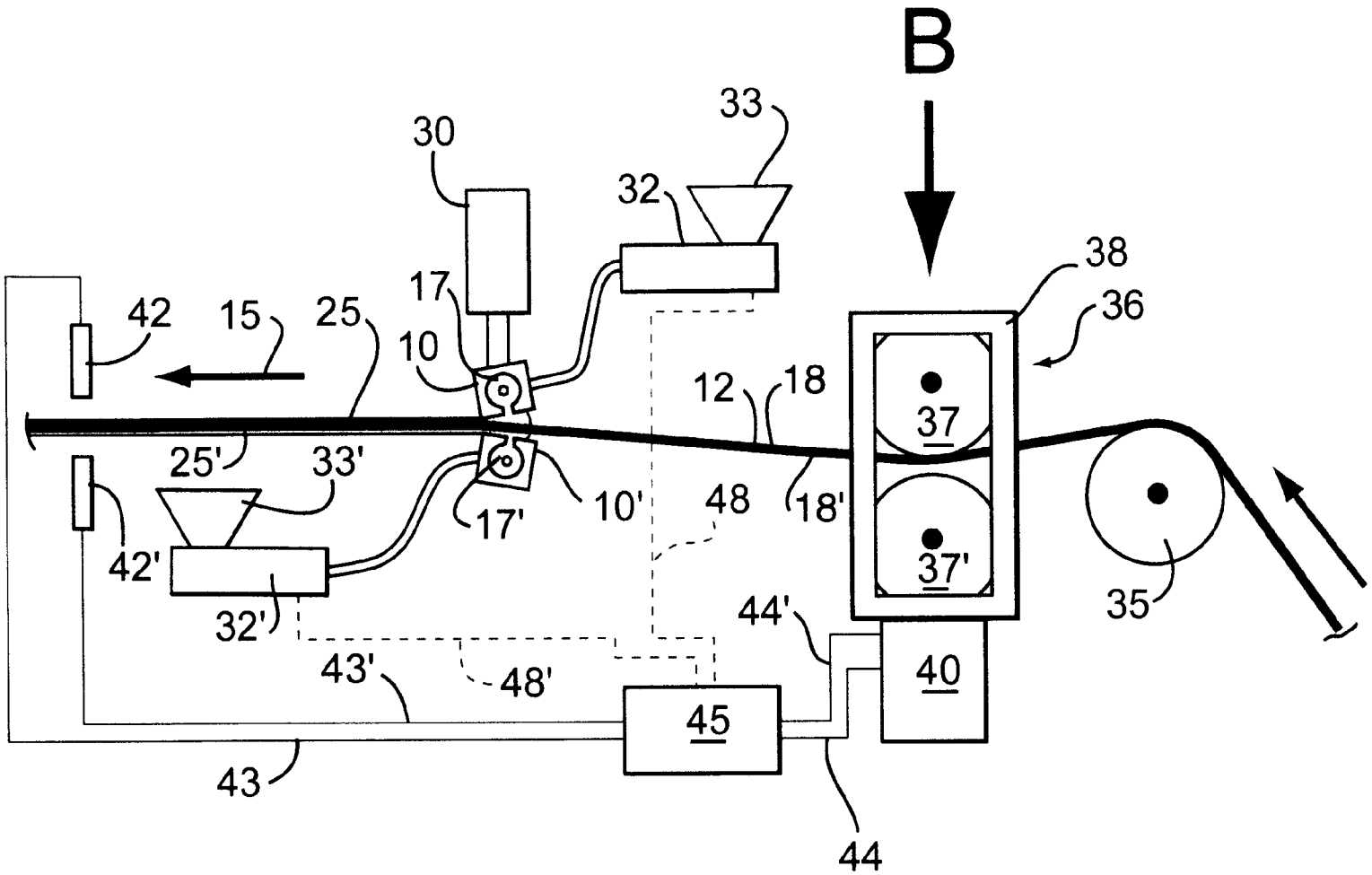
FIG. 2B is a view similar to FIG. 2A of the same apparatus, in which the means for varying the path angle are shown in a second position.

FIGS. 2A and 2B schematically illustrate a two-sided coating apparatus according to one preferred form of the present invention. In this case, the coating heads 10, 10' are both of the same size and only one (coating head 10) is allowed to float. The other coating head 10' is fixed but, as noted above, both heads act as if they floated because of vertical movement of the strip article 12 as it passes between the coating heads. To allow the floating effect, coating head 10 is acted upon by a series of piston and cylinder devices 30 (only one of which is shown in the drawing). The devices 30 act as pushing means for exerting a force 24 (see FIG. 1). Although, pneumatic (air) cylinders are preferred for this purpose, any suitable pushing means may be employed, e.g. hydraulic cylinders, coil springs, leaf springs, counter weights, and the like.

Each coating head is fed under pressure with a molten polymer coating material 17, 17' from a melting device 32, 32', e.g. a heated screw extruder device fed with polymer pellets from a hopper 33, 33'. This establishes on each of the surfaces 18, 18' of strip 12 a continuous film of the coating material 25, 25'.

It will be understood that either or both of the strip major surfaces may, if desired, bear a previously—applied undercoat or primer coat (not shown) of the same or a different coating material. The coating materials applied to the opposite surfaces 18, 18' may also be the same or different.

The strip article is advanced by a conventional pulling arrangement (not shown) first around a fixed roller 35, through a deflection apparatus 36, and between the coating heads 10, 10'. The strip normally will be taken off a fixed coil (not shown) and finally, after coating, wound onto a take-up roll (not shown). The take-up roll may incorporate or be driven by a motor (not shown) to provide the necessary strip advancement through the apparatus.

The deflection apparatus 36 in the illustrated embodiment comprises a pair of freely-rotatable rollers 37, 37' supported in a movable frame 38. The frame is movable vertically by precisely controlled amounts by a hydraulic actuator 40 connected to the frame 38 by a connecting rod 41. The deflection apparatus causes the path of the strip article 12 between the coating heads 10, 10' to be varied so that the coating angles on opposite sides of the strip can be changed, as indicated with respect to FIG. 1. This is achieved by operating the hydraulic actuator 40 to move the frame fully or partially between an uppermost position shown in FIG.

2A (in a direction indicated by arrow A) and a lowermost position shown in FIG. 2B (in a direction indicated by arrow B).

In the uppermost position of FIG. 2*a*, the lower roller 37' contacts the strip article 12 and causes it to be deflected upwards. In the lowermost position of FIG. 2B, the upper roller 37 contacts the strip article 12 and causes it to be deflected downwards. Of course, it would be possible to provide deflection apparatus of other kinds. For example, rounded or angular (non-rotatable) bars, or vertical plates, could be employed instead of rollers, or a single device having fork-like tines (one extending over the strip article and the other extending below it), may be employed. The uppermost and lowermost positions are chosen to correspond with the desired degree of adjustment of the strip path angle between the coating heads 10, 10'.

The position of the deflection apparatus 36 from the coaters 10, 10' is preferably in the range of 2 inches to 2 feet, although the range may vary considerably from one apparatus to another. The distance chosen for a particular apparatus may be a compromise between competing considerations. If the distance is large, it is easier to control the coating angle precisely (large displacements of the deflection apparatus produce small changes in the coating angles). However, large distances can lead to sag in the section of the strip article between the deflection apparatus and the coating head. Sag of this kind can lead to inaccuracies in the coating angle and oscillations producing unintended periodic variations of the coating angles. Generally, the deflection apparatus should be placed as close to the coating heads as possible (while allowing for precise adjustment). Deflection bars and plates make such close placement somewhat easier than the use of deflection rolls as shown.

As will be apparent from the Examples below, the way in which the coating thickness ratio varies with changes in the path angle can be quite complex, and further, small changes in the path angle may have significant effects on the variation of the thickness ratio. It is therefore preferable to control the precise movements of the deflection apparatus by means of a computer programmed with the changes in position required to effect predetermined thickness ratios, or to cause said ratios to approach a predetermined desired value when deviation from that value is detected. A suitable algorithm may be developed based on the known effects of changes of coating path angle on coating thickness ratios. In the embodiment illustrated in FIGS. 2A and 2B, a pair of coating film thickness sensors 42, 42' is provided on opposite sides of the strip article 12. These sensors (which may operate by infra-red absorption/reflection or other methods) are capable of continuously (or at least frequently) monitoring the thickness of the coating film 25, 25' applied to opposite sides 18, 18' of the strip article by the coating heads. This information is conveyed via wires 43, 43' to a control module 45 which contains computer circuitry for calculating the precise position of deflection apparatus 36 required for producing a predetermined thickness ratio, and the precise movements required to adjust the thickness ratio, either when desired by the operator, or when a deviation from the predetermined value is detected by the sensors 42, 42'. The control module is in turn connected to the hydraulic actuator 40 via wires 44, 44' to provide the commands necessary to effect the desired precise movements.

The control module may optionally be used to control the pressures applied to the coating material by feed devices 32, 32' to avoid overfeeding or conversely starvation of the coating materials as the coating path is changed. This control is represented schematically by dashed lines 48, 48'.

Clearly, while providing computer control is highly preferred, a manual means of control of the deflection apparatus may be provided, if desired, e.g. a set screw type of arrangement, or the like, allowing an operator to adjust the deflection of the strip article.

The deflection device 36 could be located downstream of the coating 10, 10', but this is not preferred in most cases for two reasons. Firstly, the rollers 37, 37' in this location would contact the freshly applied coating films 25, 25', possibly damaging or attenuating those films. Secondly, it is not as easy to adjust the coating angles from this location in a predictable manner.

The remainder of the coating apparatus may be the same as in the Innes patent mentioned above.

The invention is described in more detail with reference to the following Examples, which are not to be regarded as limiting the scope of the present invention.

EXAMPLE 1

In this Example, tests were carried out with a single-sided coater apparatus to assess the change in coating thickness with variation of land (coating) angle in order to provide basic information that may be used in two-sided coating according to the present invention.

Trials were carried out on a 12-inch Alcan Direct Coater (ADC) line in order to evaluate Dextec™ polymer coatings obtained from Valspar™ Corporation of Pittsburgh, Pennsylvania, U.S.A. The shipment included gaylord quantities of two formulations, Dextec™ 96/602/15 and Dextec™ 96/602/16, both based on Dupont® 8306 polyester resin. Of the two, the former is lower in melt viscosity than the latter, and it was anticipated that this difference in viscosity would result in different coating thicknesses when applied simultaneously on the 30-inch line. These formulations are quite similar to Dextec™ 96/602/14 which has an intermediate viscosity and which was tested on the 12-inch line in an earlier test.

The indicated coating materials were used to study the effect of the effective land angle on applied film thickness.

All the runs were carried out on a standard chrome-phosphate pre-treated metal and at an extrusion die temperature of 240° C.

Figure 3:
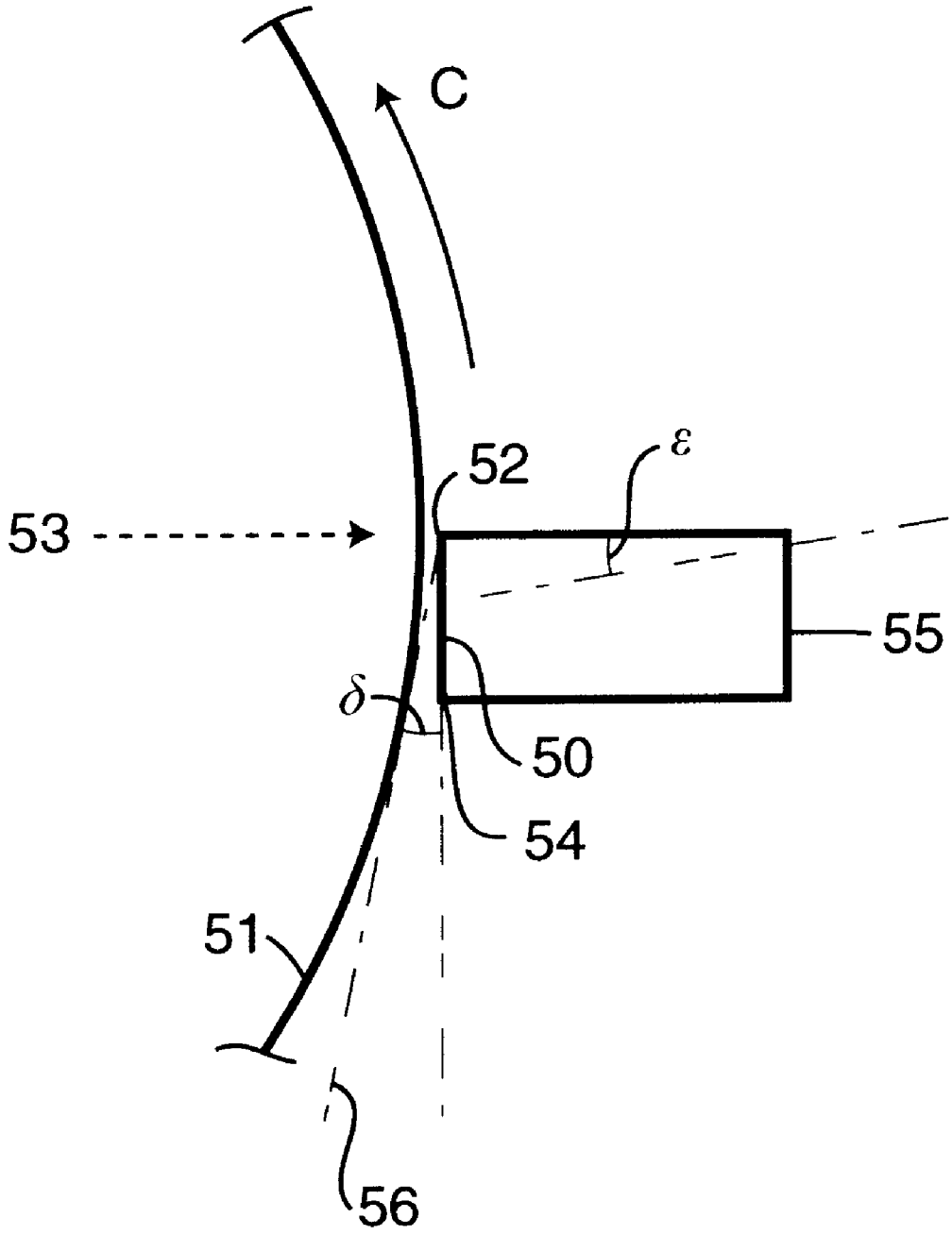
FIG. 3 is a diagram of a single-sided coater apparatus used in one of the Examples described below to investigate the affect of land angles on coating thicknesses—the diagram showns the land position with respect to the peak of a backup roll.

A set of coating runs was carried out using Dextec™ 96/602/16 for which the land angle was systematically varied in the single-sided coating apparatus. FIG. 3 is a schematic diagram of a 12 inch single-sided direct coater, showing the position of a land 50 with respect to the peak 53 of a backup roll 51, rotating in the direction of arrow C. Coating head 55 may be tilted about an angle of tilt (frame angle) $\epsilon$, but the trailing edge 52 of the land is at least initially caused to line up with the peak 53 of the backup roll 51. Because the land 50 in this case is flat and the roll surface is curved, the converging angle varies in a complex manner through the metering gap. Since the roll 51 has a diameter of 2 feet and the land 50 is 2 mm wide, when the ADC coating head 55 is set so that the angle between the tangent at the peak of the roll and the trailing edge 52 of the land is zero degrees, the angle $\delta$ between the leading edge 54 of the land and the tangent 56 to the roll 51 immediately adjacent to that edge is about 0.38 degrees. For this example, the land angle was varied between 0.4 and 1.6 degrees (i.e. the angle at the leading edge varied from approximately 0.8 to 2.0 degrees).

Figure 4:
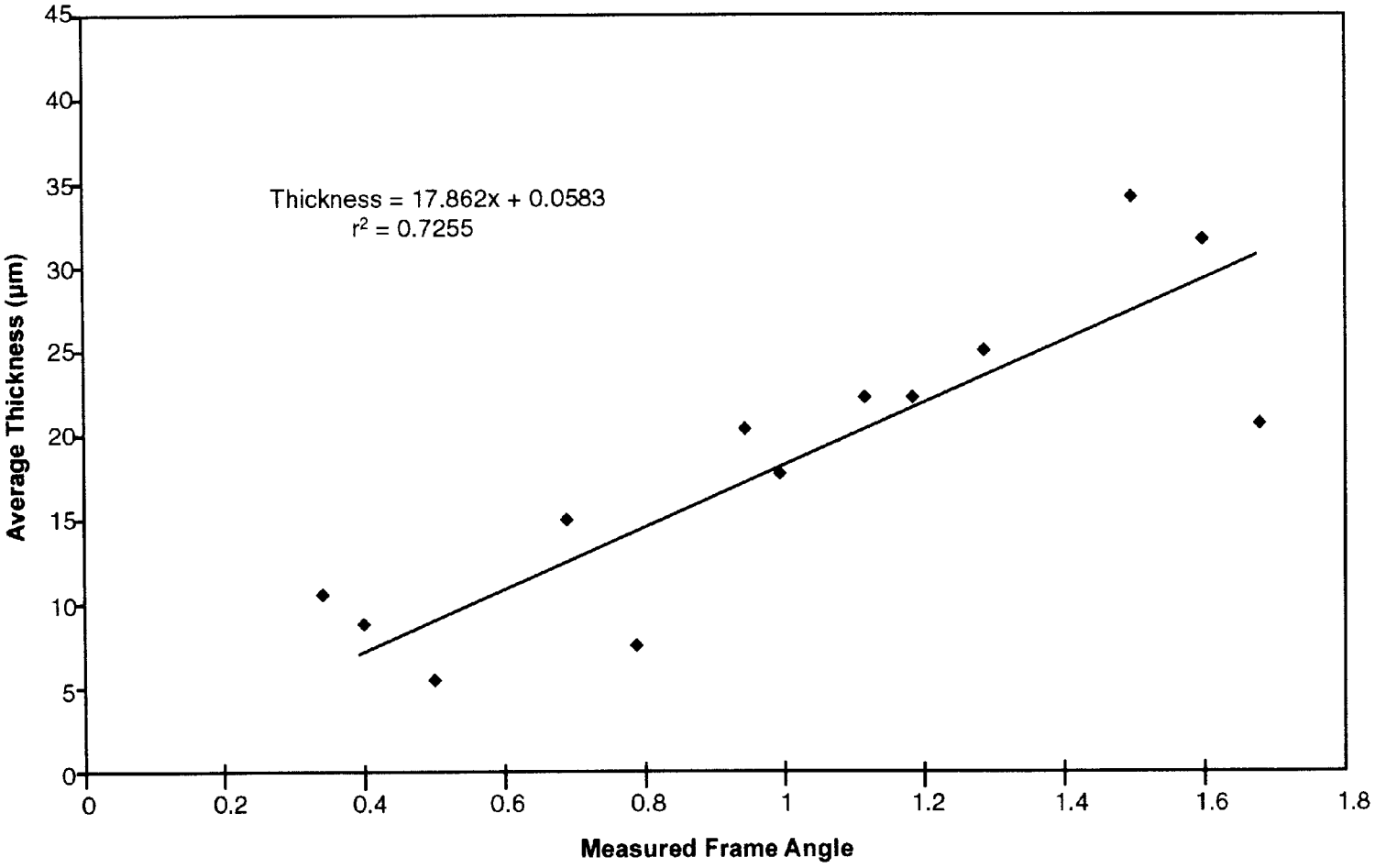
FIG. 4 is a graph illustrating a prediction of thickness ratio based on a change of pass line angle.

All the runs were carried out for Dextec™ 96/602/16 at 200 feet per minute (fpm) and with a backup roll temperature of 220° C. The coatings were applied with loads 60/55/80 psi. A plot of average thickness versus land angle is shown in FIG. 4. As expected, the mean thickness increased with angle over the range employed. The slope of the best fit line is about 18 μm/degree indicating that land angle had to be controlled quite carefully on a production line if reproducible thicknesses were to be achieved. However, these results do show that a desired ratio of film thickness can be achieved by adjusting the top and bottom land angles. Based on these results for Dextec™ 96/602/16, FIGS. 5A and 5B are predictions of what would happen to the thickness of that coating applied by a two-sided ADC if the path (pass line) were changed by 0.4 degrees.

Figure 5A:
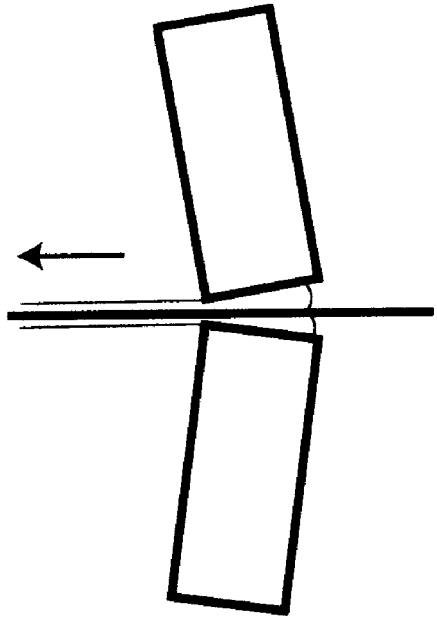
FIG. 5A and 5B are predictions of coating film thicknesses based on the results obtained in the Example 1, the variations in pass line angle being 0.4°.

FIG. 5A shows a coating operation in which the top and bottom lands are both arranged at the same angle (1.4°) to the strip article. The coating thickness is the same (15 μm) on each side of the strip.

Figure 5B:
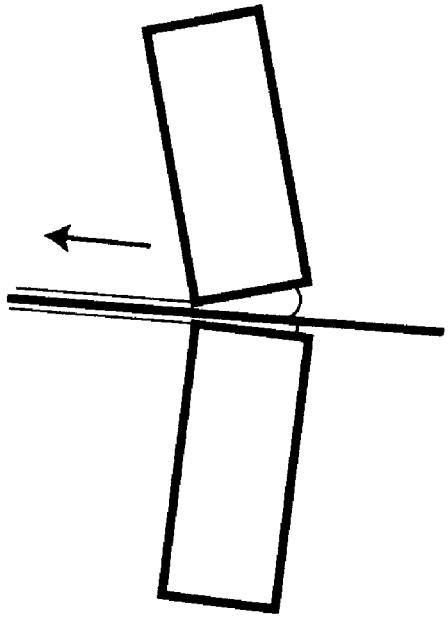

FIG. 5B shows a change in the coating operation in which the top land angle is adjusted to 1.8° and the bottom land angle is adjusted to 1.0°. The top coating thickness then becomes 25 μm and the bottom coating thickness becomes 10 μm.

EXAMPLE 2

A test is carried out in a 30-inch ADC two-sided coater equipped with a strip path deflection apparatus as shown in FIGS. 2A and 2B, in which the coating heads have land angles of 0.5° top and 0.5° bottom for a total included angle of 1.0°. For the angles to be equal top and bottom in this way, the strip must approach the coating gap exactly parallel to the reference plane between the upper and lower ADC coating heads.

FIGS. 6–9 show calculated results of the effects of land angle variation on coating layer thicknesses.

Figure 6:
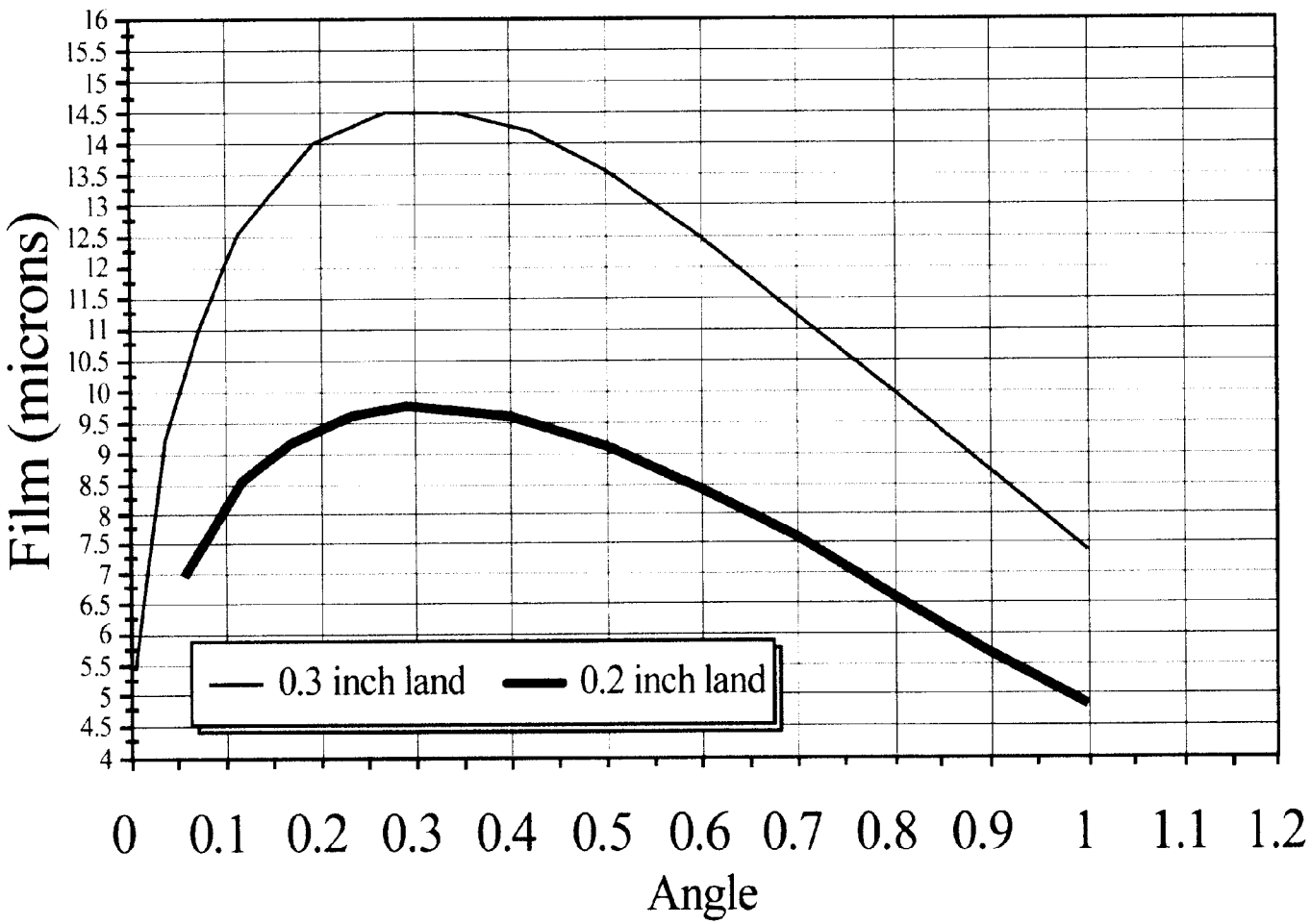
FIGS. 6 to 9 are graphs showing results obtained according to the Examples provided below.

FIG. 6 shows the effect of angle in the case of metering lands 0.2 inch and 0.3 inch wide. The coating material has a viscosity 1000 cps and is applied at 300 fpm at a load of 90 psi. The curves start from zero (i.e. metal to metal contact), rise to a maximum and then fall off. Eventually, when the angle becomes large enough, instability will occur and there will again be metal to metal contact.

Figure 7:
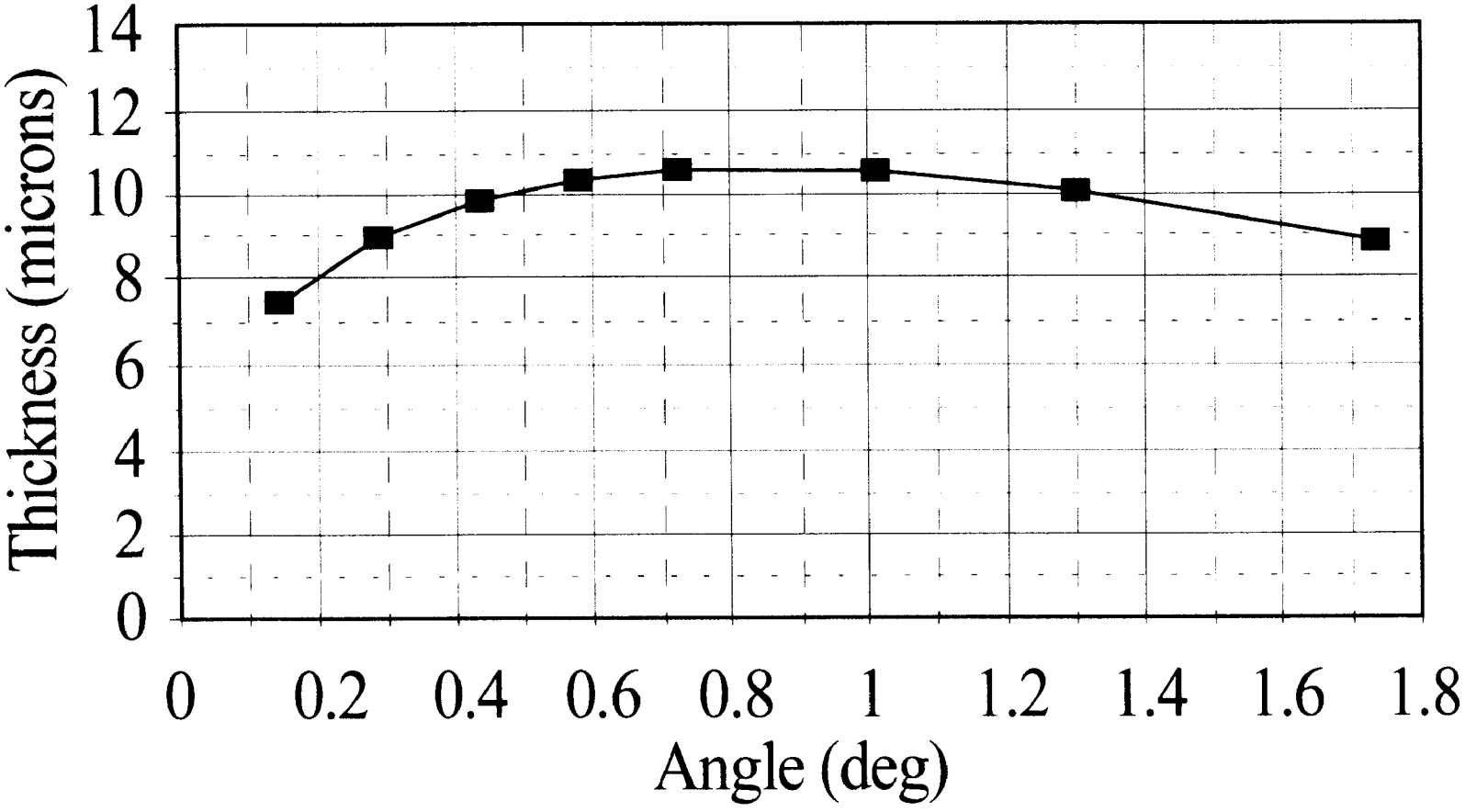

FIG. 7 shows a curve for a much narrower land (2 mm), (7500 cps) higher viscosity, lower speed (200 fpm) and lower load. Although the curve is much shallower, it still starts from a low value, has a maximum and then declines.

Figure 8:
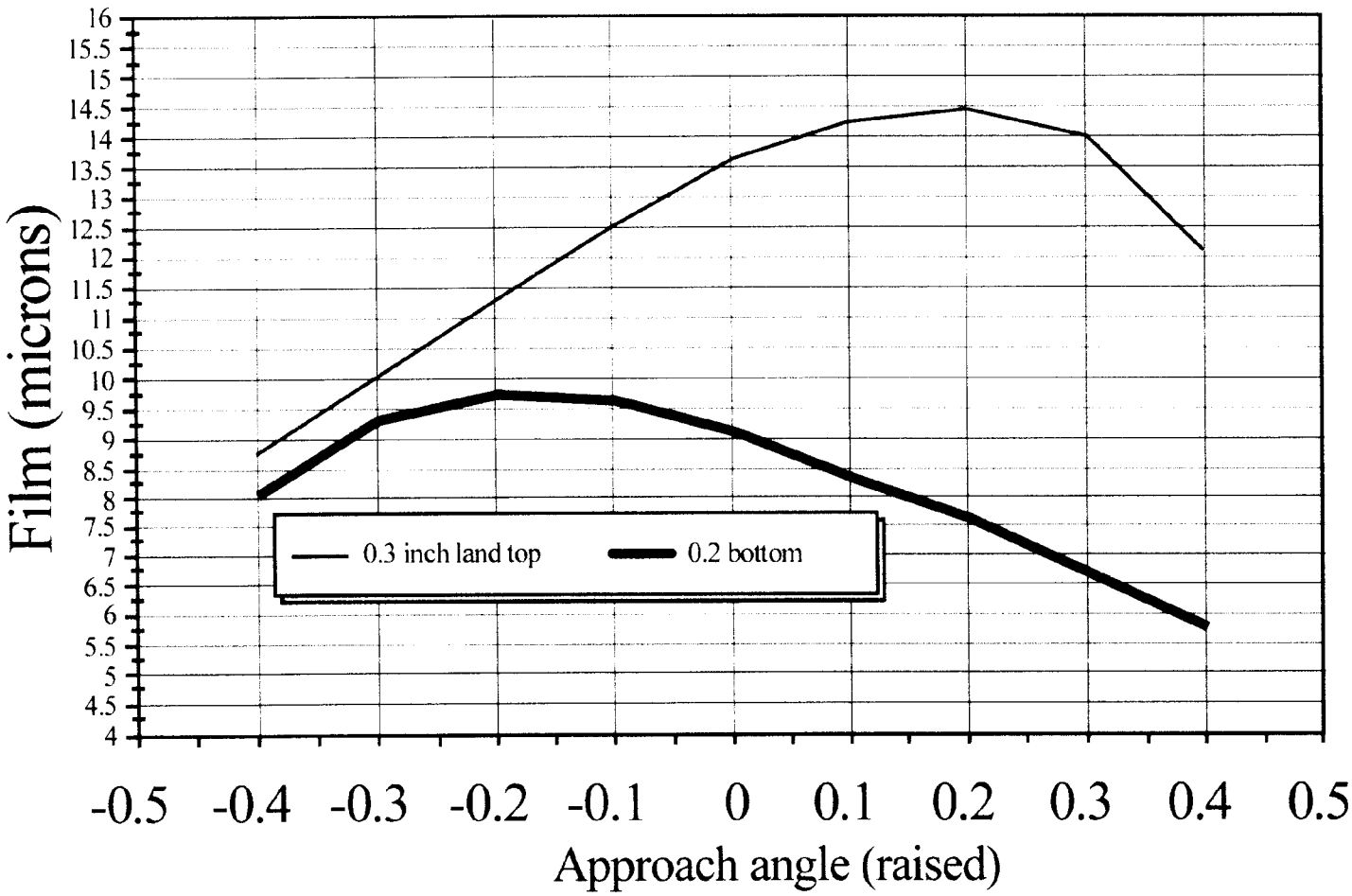

FIG. 8 illustrates the possible effects of strip entry angle when two different land widths are involved top and bottom (0.3 inch top and 0.2 inch bottom). The graph shows the effect of varying the strip approach angle (entry angle) on thickness top and bottom for a total included angle of 1°. The coating has a viscosity of 1000 cps and is applied at 300 fpm at 90 psi load.

Figure 9:
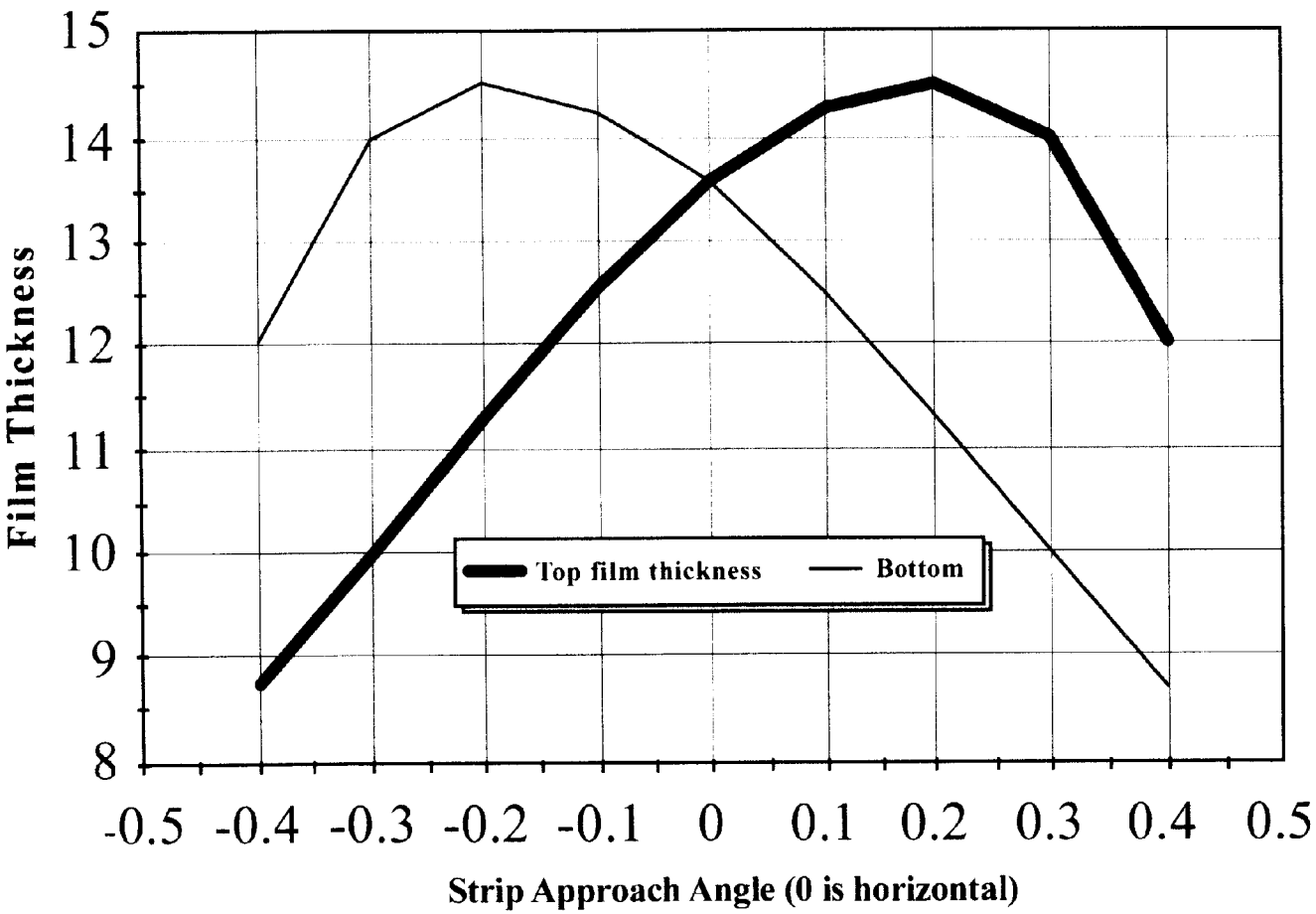

FIG. 9 shows the ratio of film thickness versus approach angle when the land widths are equal top and bottom. The results are calculated for a viscosity of 1000 cps, 1 deg, 300 fpm, 90 psi load and 0.3 inch land widths.

EXAMPLE 3

To simulate the present invention, tests were carried out using a 30-inch two-sided ADC coater for which the land angles could be varied by the use of shims to tilt the top coating head.

The results are shown in Table 1 below.

TABLE 1

| RUN | COATER | ANGLES | FILM THICKNESS (MICRONS) | NOTES |
|---|---|---|---|---|
| Run 1 Jan 15 | Top | 0.3 | 21.47 | |
| | Bottom | 0.3 | 22.17 | |
| Run 1 Jan 16 | Top | 0.45 | 24.50 | Top angle |
| | Bottom | 0.3 | 23.85 | increased |
| | | | | 0.15° |
| Run 1 Jan 23 | Top | 0.3 | 22.93 | |
| | Bottom | 0.3 | 20.43 | |
| Run 1 Jan 23 | Top | 0.15 | 23.47 | Top angle |
| | Bottom | 0.3 | 27.81 | decreased |
| | | | | 0.15° |

The results in Table 1 show that increasing the top angle by 0.150° increased the thickness of the top coating film relative to the thickness of the bottom coating film. Decreasing the top land angle by 0.15° decreased the thickness of the top coating film relative to the bottom coating film.

EXAMPLE 4

A 12- inch two-sided ADC pilot line test was carried out in which the land angles were varied by means of shims. The coating materials was oil in one set of tests and can end lacquer in another set of tests.

The results of the oil tests are shown in Table 2 below. These results show that thickness generally increases on one side if the angle for that side is increased.

TABLE 2

Coating: Paraflex ™ Polyisobutylene Oil
Viscosity = 6300 cps @ 18° C.
Land Width = 0.094 inch
Speed = 300 ft/min
Air Cylinder Pressure = 20 lb/sq. in.

| | Top | | Bottom | |
|---|---|---|---|---|
| Air Load Lbs/sq. in. | Angle (deg) | Film (micron) | Angle (deg) | Film (micron) |
| 20 | 0.48 | 31.00 | 0.15 | 37.70 |
| 20 | 0.55 | 33.80 | 0.15 | 37.40 |
| 20 | 0.95 | 37.80 | 0.29 | 31.00 |
| 40 | 0.48 | 27.30 | 0.15 | 17.40 |
| 40 | 0.55 | 30.20 | 0.15 | 21.40 |
| 40 | 0.95 | 33.70 | 0.29 | 27.10 |

The results of the lacquer tests are shown in Table 3 and these similarly show that thickness generally increases on one side if the angle for that side is increased. The results also show that changing the angle on one side can also have an effect on the thickness on the other side.

TABLE 3

Coating: High solids vinyl can end lacquer

| Top | | Bottom | |
|---|---|---|---|
| Angle (deg) | Film (micron) | Angle (deg) | Film (micron) |
| Viscosity = 5800 cps @ 30° C. | | | |
| Land width = 0.094 inch | | | |
| Speed = 300 ft/min. | | | |
| Test run = Oct 17 1986 | | | |
| Air cylinder pressure = 20 lb/sq. in. | | | |
| 0.67 | 1.50 | 0.38 | 5.60 |
| 0.69 | 3.95 | 0.15 | 1.95 |
| 0.55 | 3.90 | 0.15 | 1.85 |

TABLE 3-continued

| Coating: High solids vinyl can end lacquer | | | |
|---|---|---|---|
| Top | | Bottom | |
| Angle (deg) | Film (micron) | Angle (deg) | Film (micron) |
| Viscosity = 4900 cps | | | |
| Land width = 0.094 inch | | | |
| Speed = 300 ft/min. | | | |
| Tests run Nov 6 1986 | | | |
| Air cylinder pressure = 20 lb/sq in | | | |
| 0.95 | 0.90 | 0.54 | 5.60 |
| 1.17 | 1.50 | 0.54 | 4.70 |
| 1.38 | 2.30 | 0.54 | 4.70 |
| Land width =0.281 top/0.094 inch bottom | | | |
| 1.38 | 1.60 | 0.54 | 4.90 |
| 1.38 | 5.50 | 0.21 | 4.40 |
| Viscosity = 3000 cps | | | |
| Land width = 0.094 inch | | | |
| Speed = 300 ft/min. | | | |
| Tests run Nov 4 1986 | | | |
| Air cylinder pressure = 20 lb/sq in | | | |
| 0.71 | 3.80 | 0.15 | 1.20 |
| 0.71 | 2.70 | 0.30 | 2.90 |

What we claim is:

1. A process of producing an elongated coated strip article having a layer of coating material on each opposite surface of the strip article, each layer having a layer thickness and the coated strip article having a ratio of said layer thicknesses at any point on the strip article, the process comprising simultaneously applying layers of solidifiable liquid coating materials on said opposite surfaces of the strip article by advancing the strip article in a direction along a path between opposed coating heads, at least one of which is a floating coating head, having material delivery slots and metering lands for delivery and metering of the liquid coating materials to said opposite surfaces to form said layers, wherein said ratio of said layer thicknesses is adjusted when required by varying said path of said strip article between said floating coating heads to cause changes in angles formed between said strip surfaces and adjacent metering lands on opposite sides of the strip article.

2. The process of claim 1, wherein the path of said strip article between said coating heads is varied by deflecting said strip article from a previous path at a point upstream of said floating coating heads relative to said direction of advancing of said strip article.

3. The process of claim 1, wherein said path is varied to adjust said ratio at a time of commencement of said coating of said strip article.

4. The process of claim 1, wherein said path is varied to adjust said ratio during coating of said strip article.

5. The process of claim 1, wherein said angles between said surfaces and said metering lands are chosen to fall within a range of 0.1 to 2.0°.

6. The process of claim 1, wherein said angles between said surfaces and said metering lands are chosen to fall within a range of 0.3 to 1.0°.

7. The process of claim 1, wherein said solidifiable liquid coating material is a molten solid.

8. The process of claim 1, wherein said solidifiable liquid coating material is a solution of a solid dissolved or suspended in a solvent or carrier.

9. The process of claim 1, wherein said delivery of liquid coating materials to said opposite surfaces is adjusted when said path of strip article advance is varied to prevent overfeeding or starvation of said liquid coating materials applied to said opposite sides of the strip article.

10. A coating apparatus for simultaneously coating both opposed surfaces of an elongated strip article to form coating layers each having a layer thickness, the coated strip article having a ratio of said layer thicknesses at any point on the strip article, said apparatus comprising a pair of coating heads, at least one of which is a floating coating head, having delivery slots for solidifiable liquid coating material and metering lands for metering the liquid coating materials to form said layers, and a drive for advancing said elongated strip article in a direction along a path between said coating heads, said apparatus including a deflection apparatus for varying said path of strip article advance between said floating coating heads to cause changes in angles formed between said strip article surfaces and adjacent metering lands on opposite sides of the strip article, thereby enabling adjustments of said ratio of said layer thicknesses when required.

11. The apparatus of claim 10, wherein said deflection apparatus is positioned upstream of said coating heads.

12. The apparatus of claim 10, wherein said deflection apparatus comprises at least one deflection element in contact with the strip article on at least one side thereof.

13. The apparatus of claim 10, wherein said deflection apparatus comprises a pair of rollers, one on each side of the strip, mounted on a movable carriage.

14. The apparatus of claim 10, wherein both coating heads are floating coating heads.

15. The apparatus of claim 10, wherein only one of said coating heads is a floating coating head.

16. The apparatus of claim 10, including flow modifiers for adjusting said delivery of liquid coating materials to said opposite surfaces of the strip article when said path of strip article advance is varied, to prevent overfeeding or starvation of said liquid coating materials delivered to said opposite sides of the strip article.

* * * * *